United States Patent [19]

Wilson et al.

[11] Patent Number: 4,736,998

[45] Date of Patent: Apr. 12, 1988

[54] COMPACT WORK BENCH WITH NESTABLE SEAT

[76] Inventors: Una H. Wilson; Hugh R. Wilson, both of 10840 SW. 120 St., Miami, Fla. 33176

[21] Appl. No.: 63,535

[22] Filed: Jun. 18, 1987

[51] Int. Cl.[4] ..... A47B 83/00

[52] U.S. Cl. ..... 312/235 R; 297/140

[58] Field of Search ..... 312/235 R, 330 R, 334; 297/141, 142, 143, 140, 14

[56] References Cited

U.S. PATENT DOCUMENTS

| | | | |
|---|---|---|---|
| Re. 16,410 | 8/1926 | Woolman | 297/143 X |
| 1,473,736 | 11/1923 | Phillips | 297/141 |
| 2,881,040 | 4/1959 | Hartridge | 312/235 R |
| 3,712,667 | 1/1973 | Weber | 312/235 X |
| 4,135,604 | 1/1979 | Ryan | 312/235 R |
| 4,406,495 | 9/1983 | Turner | 312/235 R |
| 4,469,384 | 9/1984 | Fler et al. | 312/334 |

FOREIGN PATENT DOCUMENTS

| | | | |
|---|---|---|---|
| 625553 | 8/1927 | France | 297/140 |

*Primary Examiner*—James T. McCall

[57] ABSTRACT

The invention provides a compact work bench in which the seat is nestable within a cabinet-like base. A panel is provided to close the cabinet, concealing the seat that is nested within. The exterior of the cabinet is finished to resemble and be compatible with ordinary household furniture so that the work bench will not appear untidy or objectionable when not in use. Space is provided within the cabinet for the storage of tools and equipment for use with the work bench, as well as materials and supplies. The work bench is readily portable and may be used as classroom work benches for various schools, or may be used in the field.

9 Claims, 2 Drawing Sheets

COMPACT WORK BENCH WITH NESTABLE SEAT

FIELD OF THE INVENTION

The invention relates to the field of folding furniture and industrial work benches as well as home craft work benches.

BACKGROUND OF THE INVENTION

As the present cost of dwelling construction rises and the trend to smaller living space continues, an urgent need arises for a compact work bench for those people who are residing in a small apartment, condominuim or small houses known as "town houses". The present invention provides a very compact hobby work bench with a sturdy rigid seat that folds to a nesting position within the body of the work bench, when not in use, and occupies a very small amount of room space. When the exterior surfaces of the invention are finished in an attractive wood panel type of finish, the invention appears to resemble a cabibet and is compatible with articles of furniture usually found in the living areas of the average home.

In addition to the foregoing features, the present invention provides very generous storage space within the confines of the body, even after the folding seat is moved to a nesting position, and much in the way of tools, vises, small materials and supplies may be stored therein.

Although there has been activity in this field that dates back before the turn of the century, a recent patent search does not reveal anything in the prior art that discloses or anticipates the novel features and construction of the present invention.

A good number of the structures shown in the proper art are very complicated and have a construction design requiring the use of many component parts which are difficult and expensive to make and to assemble. In addition to the difficulty and expense of making such articles, the general appearance of the article after folding is so untidy, that it is necessary to store such furniture in an area away from ordinary living areas. Examples of complicated structure and unsightly appearance after folding can be found in Karschitz et al., U.S. Pat. No. 1,367,908, Bulik et al., U.S. Pat. No. 1,173,480, and Schrader et al., U.S. Pat. No. 2,766,812. By contrast, the present invention provides a novel structure, which when in a nested position, presents a very pleasing exterior appearance that blends in with various articles of furniture, is very tidy in appearance, need not be removed from a living area, and which also provides concealed storage for tools and materials.

Also found in the prior art of record is a variety of tables with folding seats or benches. Examples of such tables are: Blossom et al., U.S. Pat. No. 2,321,177, McDaniel et al., U.S. Pat. No. 362,223, Lewandoski at al., U.S. Pat. No. 1,457,582, Green et al., U.S. Pat. No. 2,521,160, and Wohlk et al., U.S. Pat. No. 2,539,603. Although the foregoing structures do have something in common with the present invention, they appear to have a primary object of simply providing vacant floor space when the seats or benches are not in use.

Of greater interest as prior art is Sell et al., U.S. Pat. No. 430,442. The sell Patent discloses a desk and other articles of furniture having seating structures that may be folded and stored within the interior of the furniture. The present invention however is primarily a work bench. The construction of the present invention provides a very rigid structure. Because of the many varied uses to which a work bench may be put, the structure must be such that it can withstand strong force vectors in all directions. The present invention provides strong rigid locking means to securely lock the component parts together against movement in any given direction. With weight of the user resting on the seat of the present invention, all force vectors exerted against the work surface are confined within the structure. As the seat is securely connected to the work surface via the rails. The work surface cannot move away from the seat or the user and remains stationary on the floor surface. This feature is not found in the prior art of record as cited herein and in itself, represents a novel and useful departure from the prior art. Also of interest is Balmos et al., U.S. Pat. No. 1,867,799, disclosing a chair seat that is foldable and storable in a sewing machine cabinet. The foregoing description of the present invention also applies to Balmos et al. as well as to McNamara et al., U.S. Pat. No. 1,256,811.

The present invention, therefore, presents a very novel and useful departure from the prior art and provides a decor compatible work bench that may be quickly placed in position for use, may be used for tool storage, and when returned to a nested position will appear as an article of furniture in a living area of most dwellings.

Although but a few of the novel features of the present invention have been described, the novelty and usefulness of the invention will become more apparent after a reading of the summary and detailed description that follow.

SUMMARY OF THE INVENTION

The principal object of the invention is to provide a compact work bench that fits well into the decor of the average home, apartment, or condiminium unit, is inconspicious, may remain in position against a wall when in use, is easy to set up for use and easy to fold away when not in use.

In the most simple form, the work bench body is made of thick plywood in the shape of a rectangular box or cabinet. Two plywood rail members are pivotally mounted mounted at the end to the inside surfaces of the sides of the cabinet body and extend outwardly at right angles from the body and parallel to the floor surface upon which the bench is resting. A "U" shaped seat member is mounted toward the opposite end of the two rail members. The seat member is locked in an upright position between the two rails and the two rail members are locked tightly against the inside walls of the body cabinet. With weight of the user resting directly on the seat member, the bench cannot move about the floor surface and force vectors in all directions against the body cabinet are contained within the work bench structure to avoid separation of the seat member from the body cabinet and restrains twisting of the structure as a unit. In this manner, the present invention provides a sturdy and stable work bench that is readily available to the user and that eliminates the need for a separate work shop.

Accordingly, it is a primary object of the present invention to provide a compact work bench for use in compact living areas.

It is a further object of the present invention to provide a work bench that is decor compatible with furniture in a living area of a dwelling.

It is a still further object of the present invention to provide a compact work bench wherein force vectors that are exerted against the work surface are contained within the work bench structure.

It is another object of the present invention to provide a decor compatible compact work bench that includes storage space for storage of various tools and materials.

It is a still further object of the present invention to provide a compact work bench that is readily portable.

It is still another object of the present invention to provide a compact and portable work bench that may be used for industrial purposes and that may be adapted to classroom use.

The invention will be better understood after reading the following detailed description of the embodiments thereof with reference to the appended drawings, in which:

DETAILED DESCRIPTION

Figure 1:
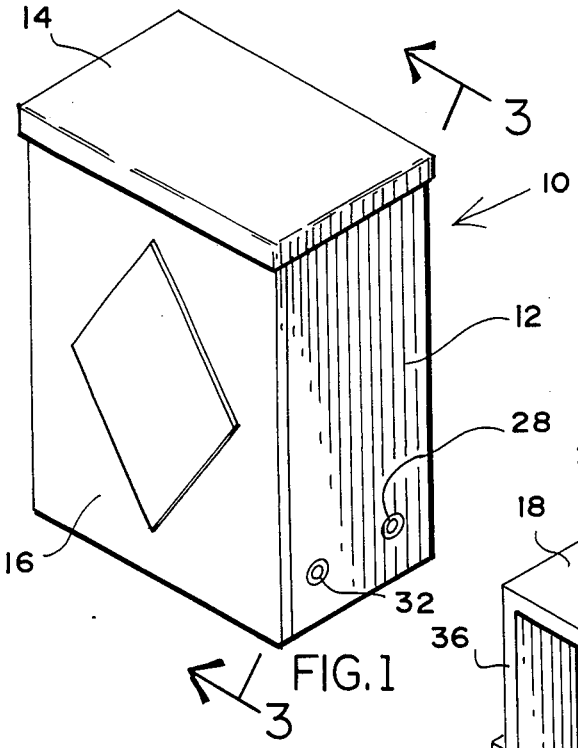
FIG. 1 is a perspective view showing the top panel and the front panel assembled to the cabinet body.

Referring to the drawings by characters of reference, FIG. 1 presents a front perspective view of the work bench 10. The cabinet body 12 together with the top panel 14 and the front panel 16, are finished with veneered panel wood of a type that is compatible with ordinary living room furniture and when assembled as shown in FIG. 1, will appear as part of the furniture usually found in an average living room of a dwelling, with only the bolt hole 28 and the bolt hole 32 breaking the visible outside surfaces of the work bench.

Figure 2:
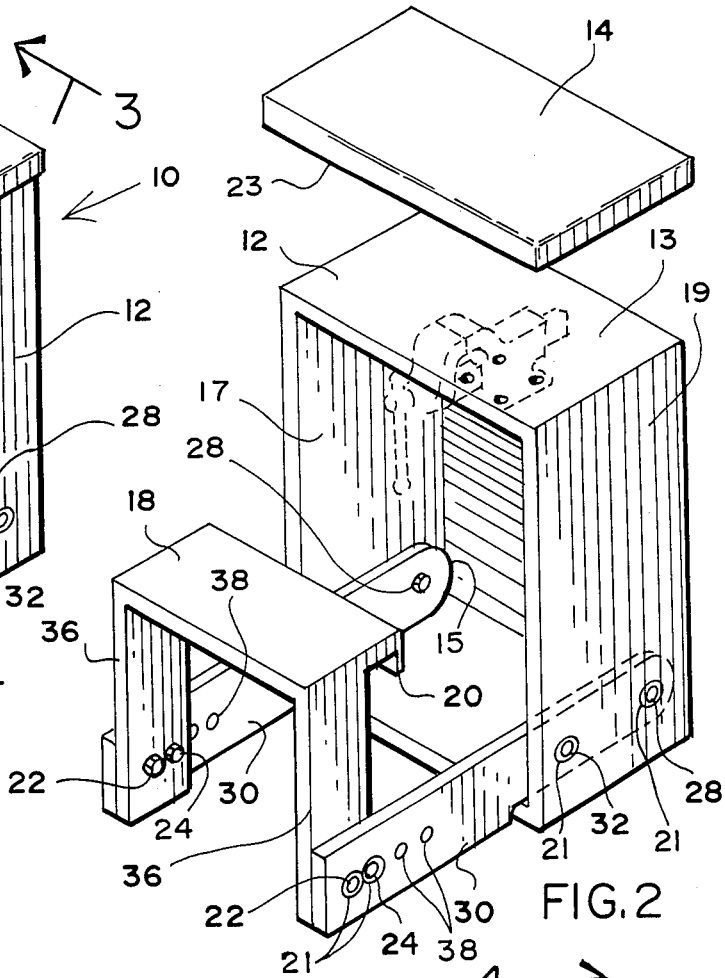
FIG. 2 is a perspective view showing the work bench with the seat unfolded from the interior of the cabinet, and locked in the position for use.

Turning now to FIG. 2, a perspective view shows the work bench 10 with the front panel 16 removed and the top panel 14 raised from the cabinet body 12. The two rails 30 are pivoted downwardly from within the cabinet body 12 on bolts 28 and are locked tightly against the interior surface of the side wall 19 by insertion of a bolt through hole 34 of the rail 30 and hole 32 in side wall 19, and into "T" nut 21 (see also FIG. 3) which is recessed into the side walls 17 and 19. The seat member 18 has been pivoted upward on bolts 24 to a verticle upright position and has been locked tightly in position by insertion of the bolts 22 through the seat support or legs 36 and into the "T" nuts 21 which are recessed into the rails 30. The additional holes 38 in the rails 30 are provided to allow the seat member 18 to be positioned closer to the cabinet body 12, if so desired. A radius 15 is cut on one end of the rails 30 for clearance during the aforementioned pivoting movement. A vise (in phantom) is shown as mounted on the work surface 13 of the cabinet body 12 for illustration. Such a vise would be removed before replacing the top panel 14. The top panel 14, when placed in position on cabinet body 12, will cover and conceal any vise mounting holes, scars or stains, arising from the use of work surface 13. A vise or other tools and equipment may be stored on the underside of seat member 18 when seat member 18 is in a nested position as shown in phantom in FIG. 4, and is retained there by the lip 20 as shown in FIGS. 2 and 3.

Figure 3:
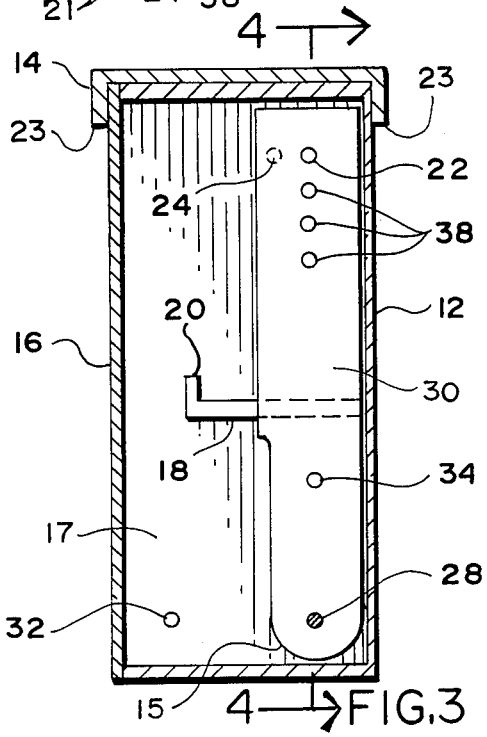
FIG. 3 is a cut-away view showing the nested position of the seat and rails within the cabinet, when the bench is not in use.

Turning now to FIG. 3, a sectional side view is Illustrated in which the top panel 14 is shown mounted on the top of cabinet body 12 with the flange 23 holding the front panel 16 against the cabinet body 12. The rail 30 is shown nested within the cabinet body 12 with seat member 18 nested within the rails 30. Seat member 18 projects slightly from between the rails 30, showing the retaining lip 20. Also shown are the pivot bolts 28, the locking holes at 34, seat member mounting holes 22, 24 and 38 and the side wall 17. Hole 32 will be in alignment with hole 34 when the rail 30 swings down in the open position and receives a locking bolt for locking rail 30 in a rigid position with cabinet body 12. Radius 15 provides clearance for movement of rail 30.

Figure 4:
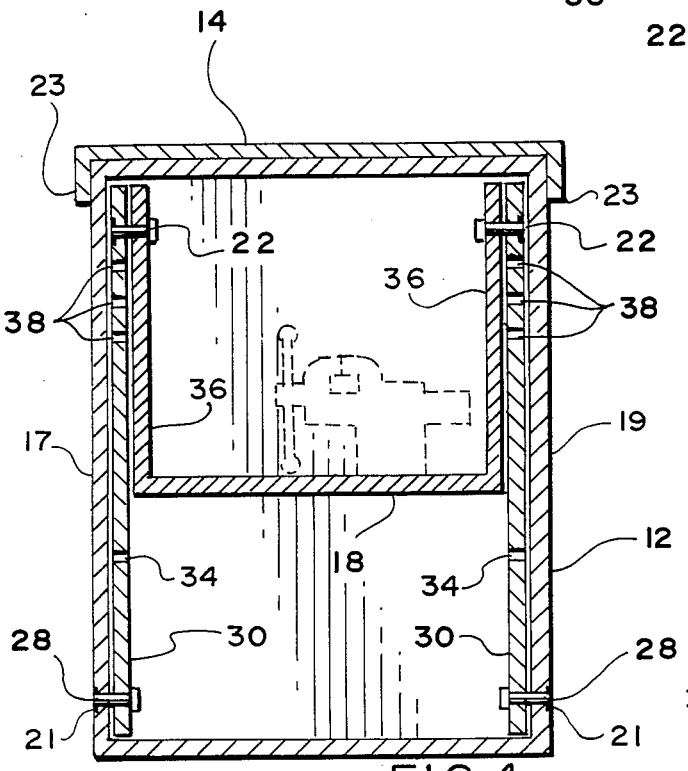
FIG. 4 is a sectional front view showing the nested position of the seat and rails when the bench is not in use.

FIG. 4 is a front sectional view and shows a vise (in phantom) stored on the underside of seat member 18. Seat member 18 is held to rails 30 by bolts 22 and is nested within the cabinet body 12 along with rails 30, seat member 18 now being in an inverted position. Rails 30 are secured to cabinet body sidewalls by bolts 28 and "T" nuts 21 in the sidewalls 17 and 19. Locking holes 34 in rails 30 are shown as well as seat adjustment holes 38. The top panel 14 is shown in place on cabinet body 12 with the flange 23 extending downward to retain top panel 14 on the cabinet body 12.

FIGS. 1–4 illustrate the preferred embodiment of the present invention, however it is not intended that the invention be limited to that structure. FIGS. 5–8 illustrate a variant model of the present invention in which the seat member is also nested within the cabinet body, but by a sliding motion rather than as shown in FIGS. 1–4.

Figure 5:
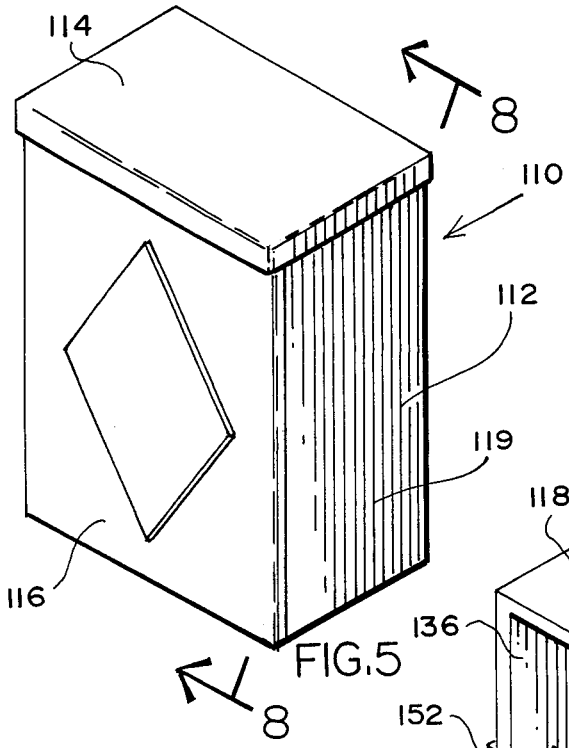
FIG. 5 is a perspective view of a variant model of the work bench and is shown in the assembled and closed position.

FIG. 5 illustrates a variation, but the outward appearance is practically the same as that shown in FIG. 1. The cabinet body 112 is shown with the top panel 114 in place and extending downward over side wall 119 and front panel 116. The assembled unit 110 being constructed with an outside finish that will be compatable with usual and ordinary household furniture, when in a closed position.

Figure 6:
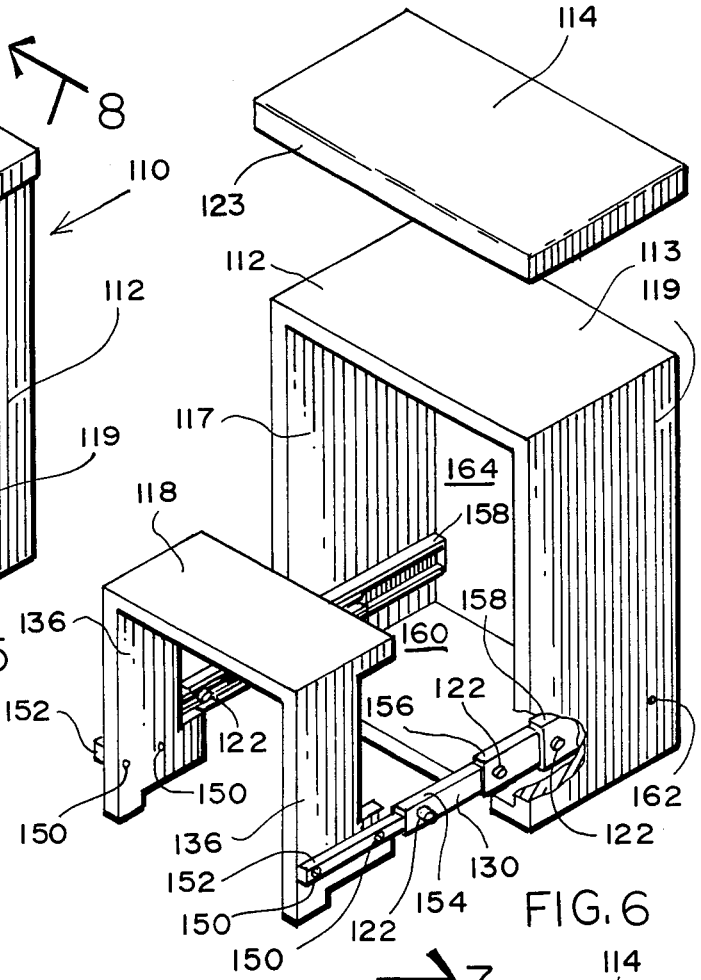
FIG. 6 is a perspective view of the invention in the open position, with the seat extended, the front panel removed, and the top panel suspended above the work surface.

Turning now to FIG. 6, a perspective view is presented that shows the present invention in an opened position. The front panel 116 has been removed and is not shown. The top panel 114 is shown as removed and above the cabinet body 112. The seat member 118 is extended from the nesting position. The seat member 118 is attached to the cabinet body 112 by the two telescoping rails 130. The rail 130 is composed of four parts. A first member 152 is attached to the seat member 118 by the two screws 150 and is fitted to slide back and forth within the second member 154. Telescoping member 154 in turn, is fitted to slide back and forth within telescoping member 156 and telescoping member 156 is fitted to slide back and forth within the stationary telescoping member 158. The sliding action of the four members allowing the seat member 118 to be moved forward into the interior of the cabinet body 112 for nesting therein. The telescoping member 158 is attached to the interior of sidewall 119 by two screws 162 (one of which is not shown due to cut away) and is rigidly fixed to sidewall 119. A matching rail is fitted to the opposite side of the seat member 118 and extends to sidewall 117 in a like manner. The four telescoping members, 152, 154, 156 and 158 may be locked together by insertion of the three locking pins 122. The locking pins are inserted from the inside and when withdrawn, permit the seat member 118 to be moved forward to the nesting position within the interior of cabinet body 112. When seat 118 is in the nesting position, the space between the seat legs 136 and the space above the seat 118 may be used for the storage of tools, supplies and equipment. The work surface 113 is covered by the top panel 114 and will conceal any surface scars that have been occasioned by work operations. The rear wall 164 seals the cabinet body 112 and reinforces the cabinet body 112 against distortion during use. The flange 123 of the top panel 114 retains the front panel 116 (not shown) when the front panel 116 is in a closed position. Although front panel 116 is shown in the drawings as being removable, it will be apparent to those skilled in the art that such a panel may also be attached to the cabinet body 112 by hinge means so that the panel may swing away to allow the seat 118 to emerge for use.

Figure 7:
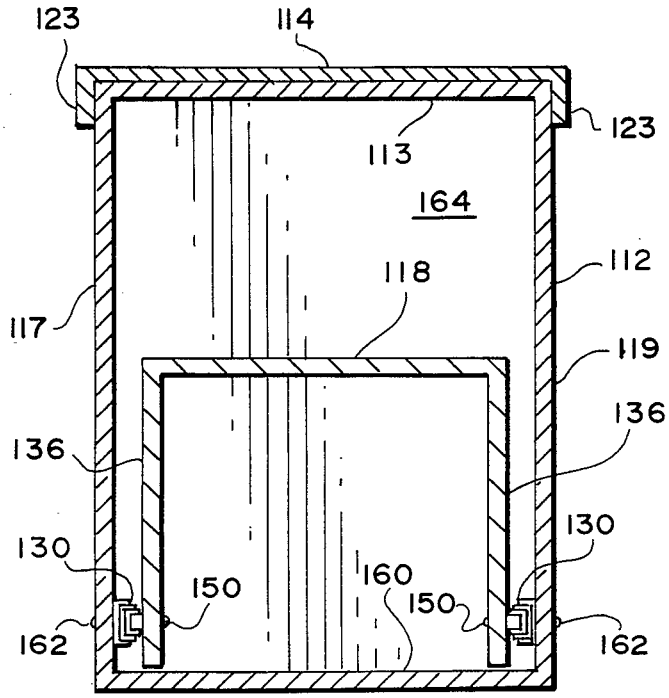
FIG. 7 is a sectional front view showing the invention in the closed position with the seat nested within the cabinet body and the top panel in place.

FIG. 7 presents a front cross sectional view of the variant model in the closed position. The cabinet body 112 is shown with the top panel 114 in place, the flange 123 extending downward over side walls 117 and 119. The seat member 118 is nested inside of cabinet body 112, the seat legs 136 extending downwardly and being connected to telescoping rails 130 by the screws 150 and the two telescopiing rails 130 also attached to Cabinet body 112 by the two screws 162. Also illustrated is back panel 164, bottom panel 160 and work surface panel 113.

Figure 8:
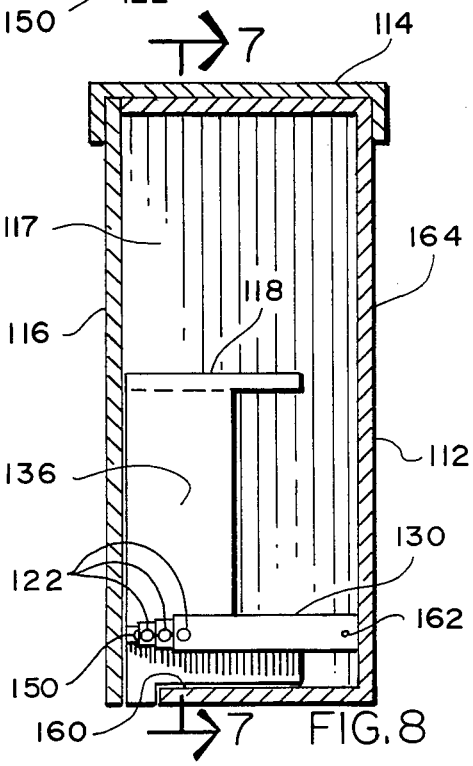
FIG. 8 is a sectional side view showing the invention in the closed position, with the seat nested within the cabinet body and the top panel in place. The telescoping rails of this variant form are shown in the telescoped position. The seat and the telescoping rails remain in an upright position.

Turning now to FIG. 8, a side sectional view is presented and a nested view is illustrated. The cabinet body 112 is shown with front panel 116 in place and hole by top panel 114. The interior surface of the side wall 117 is shown, the seat member 118 being enclosed in a nested position, the telescoping rail 130 being in a telescoped position, the locking pins 122 now being in the unlocked position. The telescoping rail 130 is secured to the seat leg 136 by the screw 150 and to the inner cabinet sidewall 119 (not shown) by the screw at 162. The back panel 164 is shown as well as the bottom panel 160.

Having described the presently preferred embodiments of the invention, it should be understood that various changes in construction and arrangement will be apparent to those skilled in the art and are fully contemplated herein without departing from the true spirit of the invention. Accordingly, there is covered all alternatives, modifications and equivalents as may be included within the spirit and scope of the invention as defined in the appended claims.

What is claimed is:

1. A cabinet, convertible to a work bench, comprising:

a cabinet body having a work surface mounted thereon, seat means, rail means for connecting said seat means to said cabinet body, one end of said rail means being pivotally connected to the interior of said cabinet body, the other end of said rail means being pivotally connected to said seat means, said seat means and said rail means being pivotally movable to a nested position within said cabinet body and pivotally movable from a nested position to an extended position, locking means for locking said rail means securely to said cabinet body and for locking said rail means to said seat means when said seat means and said rail means are in an extended position, said cabinet body, said rail means and said seat means forming a substantially rigid unit when locked together in an extended position and resting on a floor surface.

2. A cabinet, convertible to a work bench, comprising:

a cabinet body having a work surface mounted thereon, seat means, said seat means having a lateral seat surface and seat support means extending downwardly to rest on a floor surface, telescoping connecting rail means, one end of which being mounted on an interior surface of said cabinet body, the other end being mounted on said seat means, said telescoping connecting rail means connecting said seat means to said cabinet body and allowing linear movement of said seat means to a nested position within said cabinet body and allowing linear movement of said seat means from a nested position to an extended position, locking means for locking said telescoping connecting rail means against linear movement when said seat means and said telescoping connecting rail means are in an extended position, said body, said seat means and said telescoping connecting rail means forming a substantially rigid unit when locked in an extended position and resting on a floor surface.

3. The structure set forth in claim 2 further comprising enclosure means for concealment of said seat means when in a nested position.

4. The structure as set forth in claim 3 wherein said enclosure means is compatible with ordinary household furniture.

5. In a cabinet, convertible to a work bench, having:

a cabinet body, a work surface mounted on said cabinet body, seat means, rail means for connecting said seat means to said cabinet body, one end of said rail means being pivotally connected to the interior of said cabinet body, the other end of said rail means being pivotally connected to said seat means, said seat means and said rail means being pivotally movable to a nested position within said cabinet body and pivotally movable from a nested position to an extended position, the combination of said cabinet body, said seat means, and said rail means, with locking means for locking said rail means to said cabinet body and for locking said rail means to said seat means when said seat means and said rail means are in an extended position, said cabinet body, said seat means and said rail means forming a substantially rigid unit when locked together in an extended position and resting on a floor surface.

6. The structure set forth in claim 5 further comprising enclosure means for concealment of said seat means when in a nested position.

7. The structure set forth in claim 6 wherein said enclosure means is compatible with ordinary household furniture.

8. The structure set forth in claim 1 further comprising enclosure means for concealment of said seat means when in a nested position.

9. The structure set forth in claim 8 wherein said enclosure means is compatible with ordinary household furniture.

* * * * *